United States Patent [19]

Small

[11] Patent Number: 4,507,802

[45] Date of Patent: Apr. 2, 1985

[54] ADAPTIVE BALLISTIC PANEL CARRYING GARMENT

[75] Inventor: Irvin L. Small, Nashville, Tenn.

[73] Assignee: Horace Small Manufacturing Company, Nashville, Tenn.

[21] Appl. No.: 491,077

[22] Filed: May 3, 1983

[51] Int. Cl.[3] ..... F41H 1/02

[52] U.S. Cl. ..... 2/2.5; 2/247

[58] Field of Search ..... 2/2.5, 243 R, 247

[56] References Cited

U.S. PATENT DOCUMENTS 4,266,297 5/1981 Atkins ..... 2/2.5

*Primary Examiner*—Louis K. Rimrodt

*Attorney, Agent, or Firm*—Mason, Fenwick & Lawrence

[57] ABSTRACT

A ballistic panel carrier garment is disclosed for adaptively receiving ballistic panels of varying configurations and sizes corresponding to the size of the garment's wearer. The garment of this invention comprises a front portion and a back portion. The back portion has a back pocket-like receptacle attached thereto having an opening for receiving a back ballistic panel. The front portion has a front pocket-like receptacle attached thereto having an opening for receiving a front ballistic panel. Each of said front and back receptacles is configured and sized to closely match the configuration and size of its corresponding ballistic panel to insure that the front and back ballistic panels are supported accurately without shifting to protect the vital parts of the garment's wearer. At least one of said front and back receptacles comprises means for adapting said one receptacle to receive in a first mode a ballistic panel of a first configuration and in a second mode for receiving a ballistic panel of a second, different configuration.

6 Claims, 20 Drawing Figures

ADAPTIVE BALLISTIC PANEL CARRYING GARMENT

FIELD OF THE INVENTION

This invention relates to ballistic panel carrier garments adapted to support and position bullet resistant ballistic panels in a manner to protect the garment's wearer and, in particular, to such garments that are adaptive to carry a wide variety of configurations and sizes of such panels.

DESCRIPTION OF THE PRIOR ART

The incidence of violent crime has necessitated the use of body armor and, in particular, the wearing of vests or other garments that support and position bullet resistant ballistic panels to protect the vital parts of the wearers. Police officers are particularly vulnerable to injury. In 1981, more than 58,000 police officers were assaulted.

Despite the grave risk, some 90 percent of the police officers who have such body armor don't wear it. First, police officers find that much of the present body armor, or its carriers, are too restrictive to permit them to perform the demanding tasks of a police officer. Further, police officers find their protective armor, or its carriers, too uncomfortable. Particularly in the summer, police officers find their body armor to be hot and to cause excessive perspiration.

U.S. Pat. No. 4,266,297 of Atkins describes a ballistic panel carrier garment in the form of a shirt that permits its wearer to readily install and remove the ballistic panels. As a result, a police officer can quickly slip the ballistic panels into the shirt-like garment in preparation for hazardous duty. When the police officer is no longer exposed to injury, he or she may readily remove the panel with a minimum of hassle or fuss. Thus, the Atkins shirt encourages the police officer to use it for hazardous duty because the shirt facilitates the installation and removal of body armor. Thus, the police officer may readily remove the ballistic panel, when on station duty, and find it as comfortable as any uniform shirt. Further, the police officer is not required to wear an additional garment such as a bulletproof vest. The Atkins shirt appears as a normal uniform shirt, even when panels are inserted. Thus, a police officer does not give away the fact that he is wearing body protecting armor.

The Atkins shirt, as described in U.S. Pat. No. 4,266,297, may be designed to resemble a normal uniform shirt and is modified to receive ballistic panels by suspending a receptacle for a ballistic panel from a top edge of a back portion of the garment. The back receptacle has an opening to receive a ballistic panel and extends freely along the back portion of the shirt to permit air circulation. The front portion of the Atkins shirt has a horizontal opening that may be closed in any conventional fashion such as a zipper. The front opening divides the shirt front into right and left chest sections. Each chest section has a front receptacle with a vertically disposed opening to be aligned with the opening of the other front receptacle. The right and left chest sections are attachable to permit the front receptacles to receive and support the front ballistic panel.

The Atkins patent states that it is preferred that the front and rear ballistic panels cover at least 75% of the upper torso of the garment's wearer. Atkins further indicates that the rear receptacle and the front right and left chest receptacles should be dimensioned to easily accept their associated ballistic panels and may be configured to conform to the shape of their contoured ballistic panels. Atkins suggests that it may be advantageous to tailor the size of the panels and the receptacles to the individual wearer's specifications. For example, the receptacle should be dimensioned to closely conform to the received panel to prevent the lateral shifting of a panel, which could leave unprotected the vital portions of the wearer's upper torso, as well as cause bunching or doubling-over of the panel within the receptacle.

It is readily contemplated that the custom measuring and tailoring of the Atkins shirt and, in particular, its receptacles to each wearer would significantly increase the cost of such garments. Federal, state and city governments that sponsor their police officers would find it difficult to bear such expense. In the face of the risk of not protecting the wearer's torso, some other means or method is required for accurately positioning the ballistic panels with respect to the wearer's body. Further, it is contemplated that ballistic panels come in a variety of shapes and each such panel must be supported to prevent its lateral shifting.

Further, the shirt as disclosed by the Atkins patent '297 does not fully protect the wearer's upper torso and, in particular, that torso portion immediately beneath the arms of the wearer remains vulnerable. The sides of a wearer are not covered or protected by either the front or back ballistic panels. It is contemplated that if a police officer raises either arm, that that corresponding side portion of his upper torso would be exposed to bullet wound.

SUMMARY OF THE INVENTION

It is therefore an object of this invention to provide a new and improved ballistic panel carrier garment that is readily adaptive to receive and accurately support without shifting ballistic panels of varying size and shape with respect to the wearer's body.

It is a more specific object of this invention to provide a new and improved ballistic panel carrier garment that supports ballistic panels in a manner to substantially fully protect the upper torso of its wearer.

In accordance with these and other objects of this invention, there is disclosed a ballistic panel carrier garment adaptive to receive ballistic panels of varying configurations and sizes corresponding to the size of the garment's wearer. The garment of this invention comprises a front portion and a back portion. The back portion has a back pocket-like receptacle attached thereto having an opening for receiving a back ballistic panel. The front portion has a front pocket-like receptacle attached thereto having an opening for receiving a front ballistic panel. Each of the front and back receptacles is configured and sized to closely match the configuration and size of its corresponding ballistic panel to insure that the front and back ballistic panels are supported accurately without shifting to protect the vital parts of the garment's wearer. At least one of the front and back receptacles comprises means for adapting its receptacle to receive in a first mode a ballistic panel of a first configuration and to receive in a second mode a ballistic panel of a second, different configuration.

BRIEF DESCRIPTION OF THE DRAWINGS

A detailed description of a preferred embodiment of this invention is made in conjunction with the following drawings in which like references are used in the different Figures for illustrating the same elements.

DETAILED DESCRIPTION OF A PREFERRED EMBODIMENT

Figure 1:
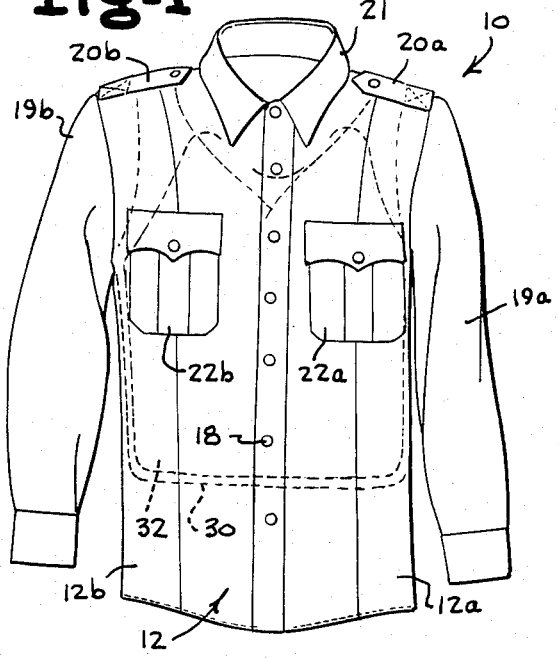
FIG. 1 is a front elevational view of the panel carrier garment with its front portion closed in accordance with teachings of the present invention.

Referring now to the drawings and, in particular, to FIG. 1, there is shown a bullet resistant ballistic panel carrier garment of the present invention identified by the numeral 10. In general, carrier garment 10 is designed to closely resemble a standard law enforcement officer's uniform shirt. However, it will be understood that any shirt or shirt-like garment may be adapted to include the carrier features of the present invention.

Figure 2:
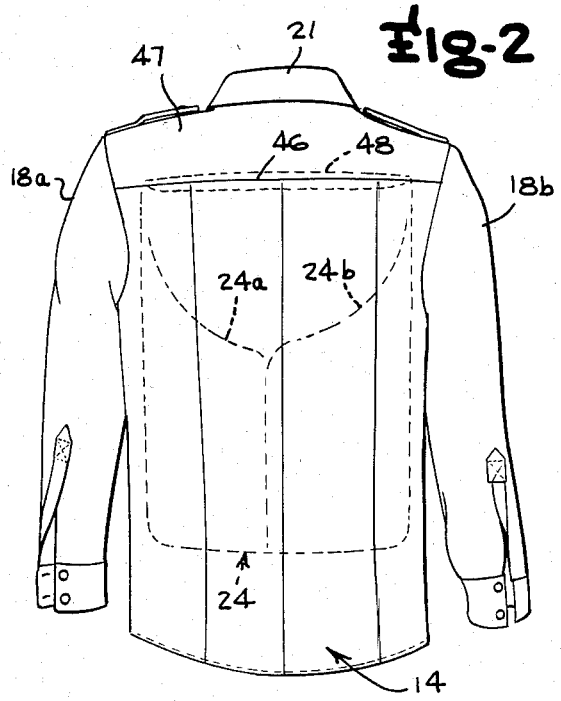
FIG. 2 is a rear elevational view of the ballistic panel carrier garment as shown in FIG. 1.
Figure 3:
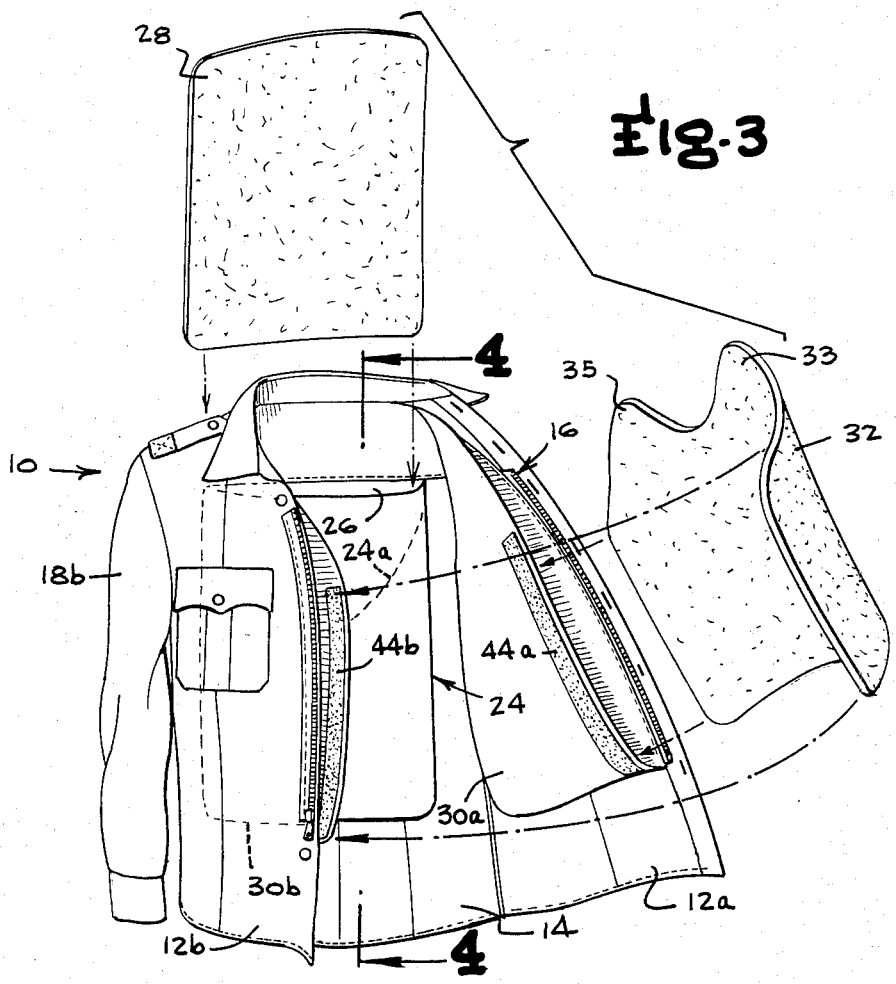
FIG. 3 is a front elevational view of the ballistic panel carrier garment of FIGS. 1 and 2 with the front portion of the garment partially opened to reveal its back ballistic panel, its back receptacle, its front ballistic panel and the left front ballistic panel receiving receptacle.

The ballistic panel carrier garment 10 includes a substantially continuous back portion 14, as shown in FIG. 2, and a closable front portion 12 forming a right half section 12*b* and a left half section 12*a*. Means are also provided, such as zipper 16, as shown in FIG. 3, for closing the front portion 12. A row of buttons, one of which is illustrated at 18, may also be provided as desired to produce the necessary shirt-like appearance. However, it will be understood that other types of closing means, such as buttons and buttonholes, VELCRO, hooks and eyes, etc., may also be provided in particular situations. It will be further understood that shirt-like garments with substantially continuous front portions and no closing means are also contemplated to be within the scope of the present invention.

In an illustrative embodiment, the garment 10 may have long sleeves 19*a* and 19*b*, front pockets 22*a* and 22*b* and epaulets 20*a* and 20*b*. However, it will be understood that other types of shirt-like garments having short sleeves, or various other types of attachments, or fabricated in a vest-like design, are contemplated to be within the scope of the present invention.

Figure 4:
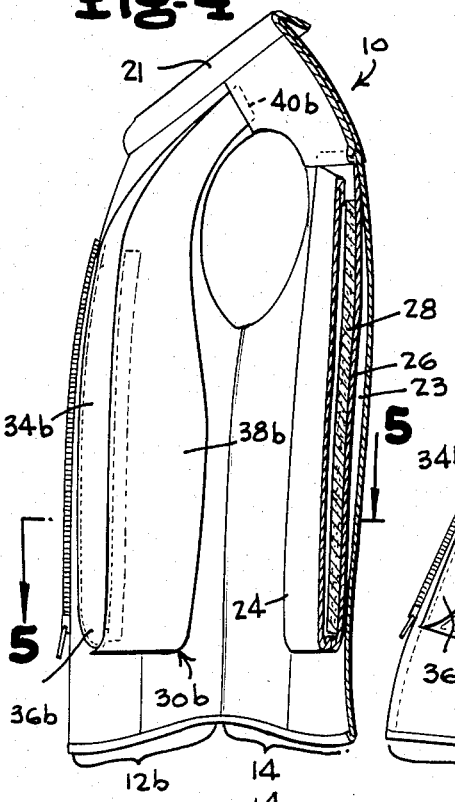
FIG. 4 is a partial, side elevational view of the ballistic panel carrier garment taken in cross-section along line 4—4 as shown in FIG. 3.
Figure 6:
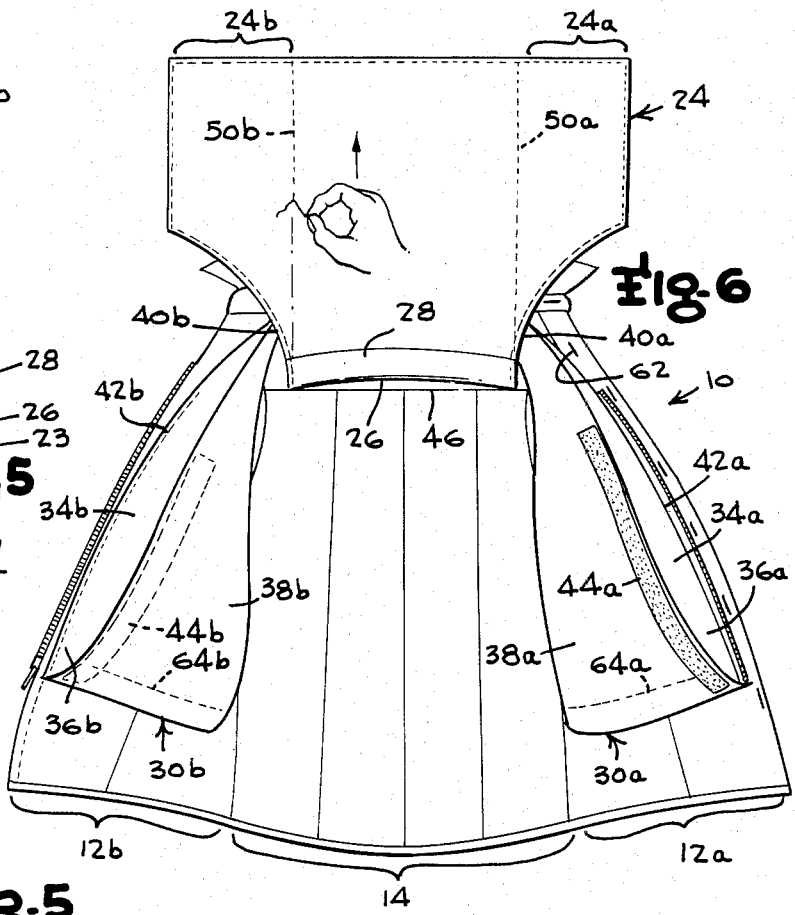
FIG. 6 is a front elevational view of the ballistic panel carrier garment as shown in FIGS. 1 and 2 with the front portion of the garment fully opened to reveal the rear ballistic panel receiving receptacle and the manner in which it may be adapted to receive rear panels of varying size and shape.

As best shown in FIGS. 3 and 6, a rear pocket-like, rectangularly-shaped ballistic panel receiving receptacle 24 is formed of cloth or the like, and contains an opening 26 provided along the upper edge thereof. Receptacle 24 is attached to the inner surface of back portion 14 by sewing or the like along a line 46 adjacent opening 26, so that the lower portion of receptacle 24 hangs freely within the garment 10 to form a slight air space 23 between the rear surface of receptacle 24 and the inner surface of back portion 14, as shown in FIG. 4. Air space 23 facilitates air circulation between receptacle 24 and back portion 14, adding to the wearer's comfort. As shown in FIGS. 2 and 6, the line 46 may be illustratively formed at the seam between the back portion 14 and a yoke 47 of the garment 10. In particular, the top-most portion of the back receptacle 24 is disposed between the back portion 14 and the yoke 47, before the four assembled layers of material are sewn together.

A flexible rear bullet resistant ballistic panel 28 is slidably and removably received through opening 26 and into rear receptacle 24 to provide protection for the upper rear torso of the wearer. For purposes of an exemplary showing, ballistic panel 28 may be of the type manufactured by A & B Industries, Inc., of Cincinnati, Ohio under the trademark Top-Line Soft Body Armor. This type of ballistic panel is constructed of a plurality of layers of KEVLAR yarn fabric, manufactured by E. I. DuPont de Nemours and Company, and covered with a polyurethane coated nylon covering. Such ballistic panels are capable of meeting or exceeding such threat levels as defined by the National Institute of Law Enforcement and Criminal Justice Standard 0101.01 (NILECJ-STD--0101.01).

As shown in FIGS. 3 and 6, front pocket-like ballistic receiving receptacles 30*a* and 30*b* are attached to the inner surfaces of left chest section 12*a* and right chest section 12*b*, respectively. Each front receptacle 30, which may be fabricated of cloth or the like, is attached at its upper edge at a seam 40 adjacent to a collar 21 of the shirt-like garment 10, so that its lower edge extends along a horizontal line positioned approximately midway on the front sections 12*a* and 12*b* of shirt-like garment 10. The lower end of each of the front receptacles 30*a* and 30*b* forms a loop portion or pocket 34*a* and 34*b*, respectively. Illustratively, the front receptacles 30 are formed by an inner layer 36 overlaying an outer layer 38 and forming therebetween its pocket 34, as shown in FIG. 6. The top-most portions of each layer of fabric are joined together and are sewn to the garment 10 along a line, as shown in FIG. 4, that forms a seam 40*b* between the front right section 12*b* and the yoke 47. The four layers of material, i.e., the yoke 47, the inner and outer layers of the receptacle 30*b* and the front right section 12*b*, are assembled together and are then sewn to form the seam 40*b*. It is understood that the left front receptacle 12*a* is secured in a similar fashion to the garment 10. Front receptacles 12*a* and 12*b* are provided with vertically extending openings 36*a* and 36*b*, respectively, which are aligned in facing relationship with each other when front portion 12 is closed to produce a substantially continuous receptacle extending across the front of garment 10. The left and right front receptacles 30*a* and 30*b* are suspended as described above to permit air circulation and to reduce blunt trauma upon missile impact.

As best shown in FIG. 3, a flexible front bullet resistant ballistic panel 32 is slidably and removably received in front receptacles 30*a* and 30*b*, with a portion of panel 32 being supported by each of the front receptacles 30*a* and 30*b*. This construction permits panel 32 to form a substantially continuous protective ballistic barrier across the upper front torso of the wearer when the front portion 12 of garment 10 is closed. Panel 32 may be constructed in a manner similar to that described hereinbefore for rear ballistic panel 28. In some instances it may be desirable to shape front panel 32 as at portions 33 or 35 to accommodate the arms or neck, respectively, of the wearer, as is well understood in the art. In addition, front ballistic panel 32 may also be shaped as required to accommodate a female torso. In general, it is preferred that front receptacles 30*a* and 30*b*, and ballistic panel 32 be dimensioned to protect at least 75% of the upper front torso of the wearer.

The assembling and wearing of the garment is illustrated best in FIG. 3. First, the rear ballistic panel 28 is disposed through the opening 26 and into the back receptacle 24. In the embodiment shown in FIG. 3, the back ballistic panel is generally of a rectangular configuration and the back receptacle 24, as shown in FIG. 3, is of a substantially similar configuration and size in order to support the back ballistic panel 28 in a manner so as not to slide with respect to the upper torso of the garment wearer.

The garment 10, as described above, is substantially similar to that as shown and described in the above identified Atkins patent '297. As will now be described, the garment 10 of this invention is adapted to receive and support back ballistic panels 28 and front ballistic panels 32 of varying sizes and configurations in a manner to prevent shifting of the panels 28 and 32 with respect to the upper torso of the garment's wearer. As shown in FIG. 6, the back receptacle 24 includes a flap 28 that serves to retain the back ballistic panel 28 within its back receptacle 24. After insertion of the back ballistic panel 28, as described above, the wearer slips into the garment 10 in the customary manner. As shown in FIG. 3, the outer layer 38*a* of the left front receptacle 30*a* has a securing strip 44*a* illustratively in the form of a self-securing fabric identified under the trademark of VELCRO. The VELCRO strip 44*a* is adapted to mate with and to be secured with a corresponding securing strip 44*b* disposed upon the inner surface of the outer layer 38*b* of the right front receptacle 30*b*. After the strips 44*a* and 44*b* have been mated as described, a continuous pocket is formed by the left front and right front receptacles 30*a* and 30*b*, whereby the front ballistic panel 32 may be readily inserted therein to provide continuous protection across the chest of the wearer. As illustrated in FIG. 3, a left portion of the front ballistic panel 32 is inserted into the pocket 34*a* as provided by the left front receptacle 30*a*, whereas the right side of the front ballistic panel 32 is disposed in the pocket 34*b* formed by the right front receptacle 30*b*. Thereafter, the front sections 12*a* and 12*b* are drawn together and the zipper 16 is drawn, thus, securing the front ballistic panel 32 in place across the chest of the wearer. To remove the garment 10, a reverse procedure is followed. It is understood that in those situations when armor is not required, the front ballistic panel 32 and the rear ballistic panel 28 may be removed. The design of the garment 10 permits the easy removal of the front ballistic panel 32 by simply unzipping the zipper 16, and removing the front ballistic panel 32. The removal of the front ballistic panel 32 improves the comfort of wearing the garment 10 by reducing its weight and making the garment 10 cooler to wear.

Figure 5:
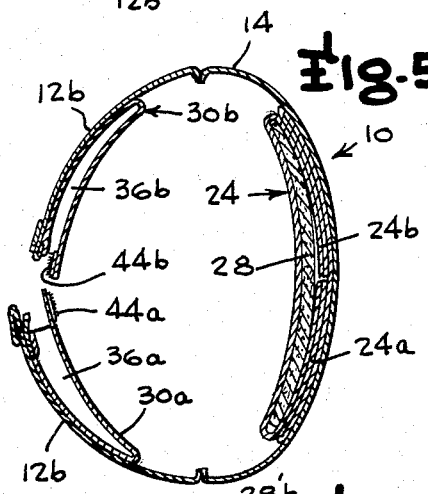
FIG. 5 is a cross-sectioned view of the ballistic panel carrier garment taken along line 5—5 of FIG. 4.
Figure 7:
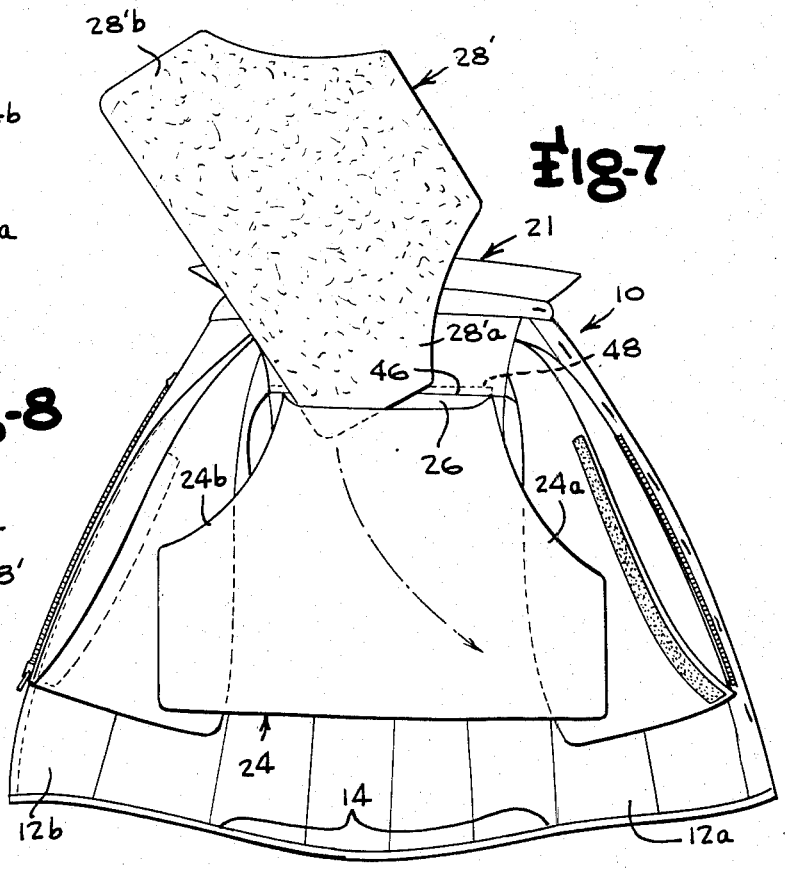
FIG. 7 is a front elevational view of the ballistic panel carrier garment with the front portion of the garment fully opened to reveal the rear ballistic panel having left and right wings that are adapted to protect the underarm, side portions of the wearer's torso.
Figure 8:
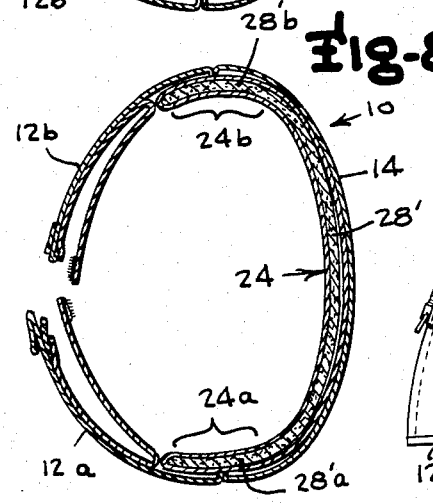
FIG. 8 is a sectioned view of the garment and rear ballistic panel as shown in FIG. 7 to show the manner in which the wings of the rear ballistic panel protect the underarm portions of the wearer's torso.

As particularly illustrated in FIGS. 6 and 7, the back ballistic panel 28 may come in a variety of configurations including the T-shape of a ballistic panel 28′ having a left ballistic wing 28′*b* and a right ballistic wing 28′*a*. The back ballistic panel 28′ affords increased protection to its wearer as illustrated in FIG. 8, protecting particularly those portions of the wearer's upper torso beneath the arms. The back ballistic panel 28 of substantially rectangular configuration, protects, as shown in FIG. 5, the back of its wearer, but provides gaps in the armor protection appearing between the front receptacles 30*a* and 30*b* and the back receptacle 24. However, the alternative embodiment of the rear ballistic panel 28′ is positioned so that its wings 28′*b* and 28′*a* protect the underarm portions of the upper torso of the garment wearer.

In order to accommodate such a back ballistic panel 28′, the back receptacle 24 is adapted, as will be explained, to receive securely not only the rectangularly-shaped panel 28, but also a T-shaped ballistic panel 28′ with right and left ballistic wings 28′*b* and 28′*a*. As shown in FIGS. 3 and 7, the back receptacle 24 is adapted to receive both the rectangularly-shaped ballistic panel 28 and the T-shaped ballistic panel 28′ with wings. As best illustrated in FIG. 6, the back receptacle 24 is provided with a left back wing 24*a* and a right back wing 24*b*. In the mode illustrated in FIGS. 3 and 5, the wings 24*a* and 24*b* are tucked inside the rear receptacle 24, whereby the outer dimensions of the rear receptacle 24 substantially conform to those of the rectangularly-shaped panel 28. When tucked in, the wings 24*a* and 24*b* do not interfere with the insertion or removal of the ballistic panel 28.

In FIG. 6, the back receptacle 24 is turned wrong-side-out to illustrate its T-shaped configuration. The chain stitches 50*a* and 50*b* serve to restrict the total extent of the pocket defined by the receptacle 24. In a first mode, with the stitches 50*a* and 50*b* in place, the pocket defined by the back receptacle 24 has a perimeter as defined by the top opening 26, the chain stitches 50*a* and 50*b* and a portion of the lower edge of the back receptacle 24. This perimeter is of substantially rectangular configuration, substantially similar to that of the ballistic panel 28. To accommodate the T-shaped ballistic panel 28′, the back receptacle 24 is converted to a second mode by removing the chain stitches 50*a* and 50*b*, as will be described below. In this fashion, the extent of the pocket formed by the receptacle 24 is increased and, in particular, the resultant pocket includes the left and right back wings 24*a* and 24*b*.

When it is desired to adapt the back receptacle 24 from its rectangular configuration to its second or T-shaped configuration, as shown in FIG. 7, the back receptacle 24 is turned wrong-side-out as illustrated in FIG. 6. Next, the set of the chain stitches 50*a* and 50*b* is unraveled. The chain stitches 50*a* and 50*b* serve to hold the back receptacle 24 in its first, rectangular configuration, as shown in FIG. 3, whereby the back ballistic panel 28 is supported without shifting to protect the upper, back portion of the wearer's torso. After removing the chain stitches 50*a* and 50*b*, the back receptacle 24 is turned right-side-in to provide the T-shaped back receptacle 24, as shown in FIG. 7. Next, the back panel 28' is inserted through the opening 26 and into the receptacle 24, whereby the ballistic wings 28'a and 28'b fit within the wings 24a and 24b respectively of the back receptacle 24. When the garment 10 is worn by the wearer, as illustrated in FIG. 8, the ballistic wings 28'a and 28'b of the rear panel 28' serve to fully protect the wearer and may abut preferrably with the front panel 32 as would be inserted within the left and right front receptacles 30a and 30b, as shown in FIG. 8.

The adaptive garment 10 of the present invention and its method of fitting, to be disclosed below, are needed to support and accurately position a great variety of panels that are presently available. It is contemplated that the potential wearer, may already have acquired selected of a great number of ballistic panels of varying size and configuration. The cost of such panels is significantly in excess of the ballistic panel carrier garment 10 of this invention. Therefore, in view of marketing and economic considerations, it is necessary to adapt the ballistic panel carrier garment 10 of this invention to receive a selected one of a variety of sizes and configurations of ballistic panels. The fitting of the ballistic panel carrier garment 10 of this invention to the selected panel in accordance of teachings of this invention is extremely important in that the selected ballistic panel needs to be properly positioned, without shifting, with respect to the upper portion of the wearer's torso. Otherwise, the wearer will be exposed to significant danger in that portions of his body will be unprotected from ballistic impact. Further, sliding panels may become doubled over causing the garment and its panels to become extremely uncomfortable to wear.

Figure 9A:
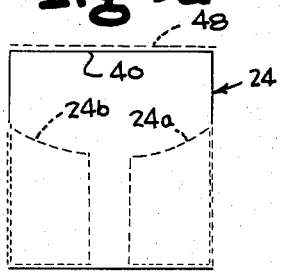
FIGS. 9*a* through 9*l* disclose the method of measuring, fitting and tailoring the ballistic panel carrier garment of the present invention with regard to the particular dimensions of a wearer.
Figure 9B:
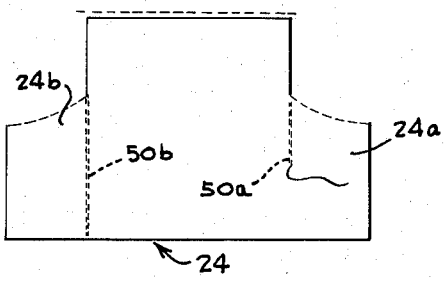

An illustrative embodiment of the method of fitting in accordance with the teachings of the present invention is disclosed in FIGS. 9a through 9l, as will now be described in detail. The present method of fitting is initiated by selecting the garment 10 based on the appropriate neck and sleeve measurements. It is contemplated that a ballistic garment could be completely custom fitted to each individual wearer including the tailoring of the appropriate size and configuration of the back receptacle 24 and the left and right front receptacles 30a and 30b, but such custom fitting and tailoring would prove to be very expensive. The method of fitting in accordance with the teachings of this invention is capable of adapting a selection of sized garments dependent upon customary neck and sleeve measurements to a particular wearer. First, the fitter observes the type of back ballistic panel 24 to be employed. If rectangular, the back ballistic panel 28 is slipped into the back receptacle 24 as shown in FIG. 9a. If the ballistic panel is contoured or provided with left and right ballistic wings 28'a and 28'b, the back receptacle 24 is turned wrong-side-out and the chain stitches 50a and 50b are removed as shown in FIGS. 9b and 6. After removing the loose threads, the fitter turns the back receptacle 24 right-side-in before inserting the T-shaped back panel 28' into the receptacle 24.

Figure 9C:
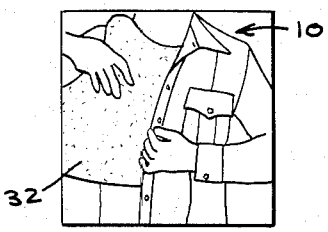
Figure 9D:
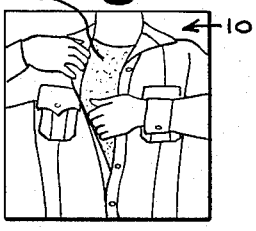
Figure 9E:
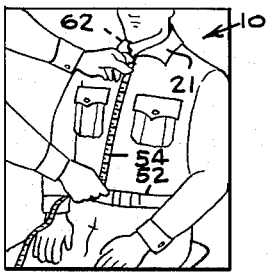
Figure 9F:
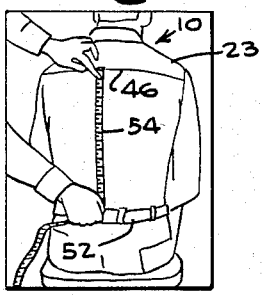

Next, the wearer slips into the garment 10, before inserting the front ballistic panel 32 into the garment 10, as shown in FIG. 9c. Before that, the wearer joins the securing strips 44a and 44b together, thereby, making a unitary pocket for receiving the front ballistic panel 32. After the front ballistic panel 32 has been inserted into both of the left and right front receptacles 30a and 30b, the front portion is closed as by zipping the zipper 16. When the zipper 16 has been completely closed and the top button of the shirt closed, the front and rear ballistic panels 32 and 28 are positioned to provide optimum wearer protection, and the garment 10 is tucked into the wearer's trousers. With the wearer sitting down, as shown in FIG. 9e, and the front and rear ballistic panels 32 and 28 resting upon the belt 52, a first or front measurement, taken from a first buttonhole 62 below the collar buttonhole down to the top of the trousers, is made using a suitable, flexible measuring tape 54 and recorded. The first buttonhole 62 forms a first or front reference point that defines the extent of armor protection afforded to the garment wearer. The front and rear panels 32 and 28 should be supported to prevent them from riding up and over the top of the trousers while measuring. Next, as illustrated in FIG. 9f, a second or back measurement is taken by the tape 54 from the line or seam 46 to the top of the trousers, while the back panel 28 is supported to prevent it from riding up and over the trousers. The second, back measurement is also recorded for further use. The seam 46 defines a second or back reference point that defines the extent of armor protection provided to the wearer's back.

Figure 9G:
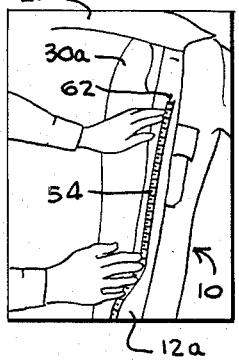

Next, as shown in FIG. 9g, the zipper 16 is unzipped and the securing strips 44a and 44b are disconnected before the left and right half sections 12a and 12b are separated to permit the taking of a third measurement. The left half section 12a is folded over and the measuring tape 54 is laid out to measure a distance from the first buttonhole 62 to a point along the row of buttonholes equal to the first measurement taken as shown in FIG. 9e; this point is marked on the inside of the left half section 12a. The left and right half sections 12a and 12b are closed and a corresponding mark on the right half section 12b is made. Next, the left and right front receptacles 30a and 30b are stitched to secure together their inner and outer layers 36 and 38 along lines 64a and 64b, respectively, as shown in FIG. 6. In this manner, the size of the pockets 34a and 34b of the receptacles 30a and 30b are fitted, i.e., decreased, to receive and to position the front ballistic panel 32 accurately with respect to the wearer in a manner to prevent shifting of the front ballistic panel 32. In an illustrative embodiment, the stitching along lines 64a and 64b is made using a single needle lock stitch sewing machine with a thread having a minimum size of 100's/2 spun 100% polyester and a minimum of 10 to 12 stitches per inch. As indicated in FIG. 6, the stitching continues to each of the securing strips 44a and 44b, where the stitch is back tacked.

The left and right front receptacles 30a and 30b are designed to accept the contoured panel 32, as shown in FIG. 3, and rectangularly-shaped panels, not shown. No additional fitting stitches are normally required with a contoured panel. However, depending on the width and shape of the panel 32, it may be necessary to place an additional vertically disposed stitch line on each of the left and right front receptacles 30a and 30b. If this should be necessary, the fitter measures the width of the front ballistic panel 32. Next, the fitter measures from a point beginning at the center of the securing strips 44a and 44b a distance equal to one-half the width measurement of the front ballistic panel 32 and places a mark on the corresponding left and right front receptacles 12a and 12b. Next, a stitch is sewn along a vertical line that is disposed substantially parallel to the edge of each half section 12a and 12b using a thread and stitch as described above.

Figure 9H:
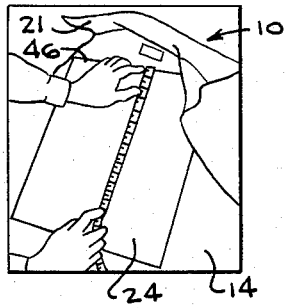
Figure 9I:
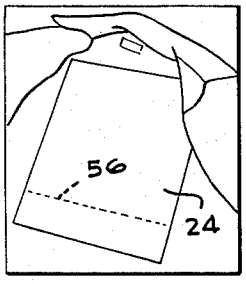

Next, as shown in FIG. 9*h*, open the garment 10 to expose the back receptacle 24. Then, measure from the seam or line 46 a distance corresponding to the second or back measurement taken in the manner as illustrated in FIG. 9*f* and mark that point on the back receptacle 24. Thereafter, sew a stitch across the entire width of the pocket 24 along a line indicated by the numeral 56. The thread and stitch may take the form as illustratively described above. The fitted receptacle 24, as shown in FIG. 9*i*, is now adapted to receive and support without shifting the rectangularly-shaped back ballistic panel 28.

Figure 9J:
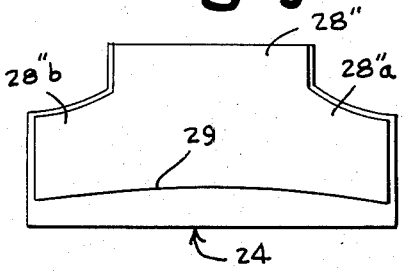
Figure 9K:
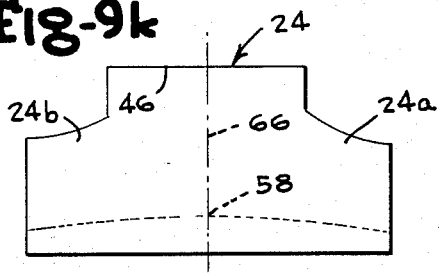
Figure 9L:
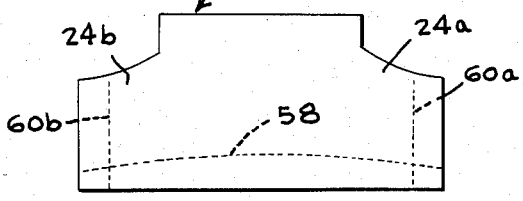

If a T-shaped back panel 28' with left and right ballistic wings 28'b and 28'a is used or a back ballistic panel 28'' having a contoured lower edge 29 is employed, a method of fitting as illustrated in FIGS. 9*j*, *k* and *l* is used. First, open the garment 10 to expose the back receptacle 24 as shown in FIG. 9*j*. Next, measure from the seam 46 a length down and along a center line 66 of the back of the panel 24 a distance equal to the second or back measurement and mark that point at the center line 66. If the back panel 28' does not have a tapered bottom edge, sew a line across the entire pocket 24 that is substantially parallel to the lower edge of the pocket 24, using a thread and stitch as described above. However, if a tapered back ballistic panel 28'' is used, it will be necessary to use a tapered stitch line 58 as shown in FIG. 9*j*. To obtain the contoured line, lay the contoured ballistic panel 28'' on the back pocket 24 so that the measurement mark and the center of the contoured panel 28'' coincide. Next, trace with a suitable marking instrument the bottom contoured edge of the panel 28'' onto the pocket 24. Next, as shown in FIG. 9*k*, sew a tapered stitch line 58 across the entire width of the back receptacle 24 using a stitch and thread as illustratively described above.

Depending on the width of the panel 28'' from left wing 28''a to right wing 28''b, it may be necessary to place additional, vertical stitch lines on each wing 24a and 24b of the back receptacle 24. First, measure the width of the back ballistic panel 28'' and, then, measure from the center line 66 a distance equal to one-half of the width measurement in each direction and mark those points. Then, sew vertical stitch lines 60a and 60b on each of the wings 24a and 24b using the illustrated stitch and thread as described above. The stitch lines 60a and 60b are disposed substantially parallel with respect to the edges of their corresponding wings. In this manner, the back receptacle 24 is adapted or fitted to receive and accurately position the contoured back ballistic panel 28'' without shifting with respect to the upper torso of the garment wearer.

Thus, there has been shown a new and improved ballistic panel carrier garment that is capable of receiving ballistic panels to more fully protect the wearer's upper torso and, in particular, those portions of the wearer's torso underneath the arms. To this end, the back receptacle, as suspended along the back of the garment, is provided with a set of wings to receive a back ballistic panel having a corresponding set of wings that extend around the back and underneath the arms of the garment wearer. Further, there is disclosed a method of adapting or fitting each of the garments of the present invention to its wearer in a manner that the front and back ballistic panels are fitted accurately with respect to the upper torso of the wearer in a manner not to shift, bunch or to override the wearer's trousers. In this manner, the physical security and the comfort of the wearer is insured.

In considering this invention, it should be remembered that the present disclosure is illustrative only and the scope of the invention should be determined by the appended claims.

I claim:

1. A ballistic panel carrier garment adaptive to receive ballistic panels of varying configurations and sizes corresponding to the size of the garment's wearer, said garment comprising:

(a) a front portion and a back portion;

(b) a back pocket-like receptacle having an opening for receiving a back ballistic panel, said back receptacle being attached to said back portion;

(c) a front pocket-like receptacle having an opening for receiving a front ballistic panel, said front receptacle being attached to said front portion; and (d) each of said front and back receptacles being of a configuration and of a size closely matching the configuration and size of its corresponding ballistic panel to insure that the front and back ballistic panels are supported accurately without shifting to protect the vital parts of the garment's wearer, wherein the improvement comprises at least one of said front and back receptacles comprising means for adapting said one receptacle to receive in a first mode a ballistic panel of a first configuration and in a second mode for receiving a ballistic panel of a second, different configuration.

2. The ballistic panel carrier garment as claimed in claim 1, wherein said adapting means comprises means for restricting said one receptacle in said first mode to form a first pocket characterized by a first set of dimensions and configuration and being adaptable in said second mode to permit said one receptacle to define a second, larger pocket of a second set of dimensions and configuration different from those of said first set.

3. The ballistic panel carrier garment as claimed in claim 1, wherein one of said back and front receptacles comprise first and second cloth layers whose perimeter is secured together to define a second, relatively large pocket, said adapting means comprised of means for releasably attaching in said first mode said first and second layers of material together along a line intersecting said receptacle perimeter to restrict the size of and to define a relatively small first pocket and releasable in said second mode to permit the size and configuration of said second pocket to be defined by said receptacle perimeter.

4. The ballistic panel carrier garment as claimed in claim 3, wherein said adapting means comprises a chain stitch of thread sewn along said line, said chain stitch being characterized by being readily unraveled to permit said first and second layers to be separated to form said second pocket.

5. The ballistic panel carrier garment as claimed in claim 4, wherein the ballistic panel is of a first, substantially rectangular configuration, and said second pocket in the first mode is configured of a substantially similar rectangular shape and dimension.

6. The ballistic panel carrier garment as claimed in claim 5, wherein the ballistic panel is of a second, substantially T-shaped configuration and said second pocket is of a substantially similar T-shaped configuration, said T-shaped configuration comprised of a rectangle portion corresponding to said first configuration and a pair of wing portions disposed on either side thereof to form said T-shaped configuration, said adapting means being disposed along those portions of said rectangle portion as separate said rectangle portion from each of said wing portions.

* * * * *